United States Patent [19]

Barrett et al.

[11] 4,010,086

[45] Mar. 1, 1977

[54] ELECTROCLEANING METHOD AND COMPOSITION

[75] Inventors: Leo Donald Barrett, Cleveland Heights; Irwin Herbert Schram, Lyndhurst, both of Ohio

[73] Assignee: Man-Gill Chemical Company, Cleveland, Ohio

[22] Filed: Feb. 20, 1976

[21] Appl. No.: 659,672

[52] U.S. Cl. ..... 204/141.5; 204/145 R; 252/86

[51] Int. Cl.[2] ..... C25F 1/06; C25F 1/02

[58] Field of Search ..... 204/141.5, 144.5, 145 R; 252/86, 80

[56] References Cited

UNITED STATES PATENTS

| | | | |
|---|---|---|---|
| 2,915,444 | 12/1959 | Meyer | 204/145 R |
| 3,207,683 | 9/1965 | Hermann | 204/144.5 |
| 3,796,645 | 3/1974 | Fujita | 204/145 R |

*Primary Examiner*—T. M. Tufariello
*Attorney, Agent, or Firm*—Fay & Sharpe

[57] ABSTRACT

An improved method of electrocleaning metal is provided which includes passing electrical current through the metallic article to be cleaned while it is positioned in an aqueous alkali metal hydroxide containing electrolyte to which has been added a cleaning agent selected from the group consisting of 1-hydroxyethylidene-1,1-diphosphonic acid, an alkali metal salt of 1-hydroxyethylidene-1,1-diphosphonic acid and mixtures thereof.

Compositions for the practice of the above method are also disclosed.

22 Claims, No Drawings

ELECTROCLEANING METHOD AND COMPOSITION

BACKGROUND OF THE INVENTION

1. Field of the Invention

The present invention relates to the electrocleaning of metals and concerns the use of a novel aqueous electrolyte which is obtained by dissolving an effective amount of a cleaning agent selected from the group consisting of 1-hydroxyethylidene-1,1-diphosphonic acid, an alkali metal salt of 1-hydroxyethylidene-1,1-diphosphonic acid and mixtures thereof in an aqueous alkali metal hydroxide containing solution.

2. Description of the Prior Art

The electrocleaning of metals with alkali metal hydroxide based formulations is well known in the metal finishing art and has been used extensively for many years. Generally, the metallic article to be cleaned is positioned in a suitable bath and electric current is passed through the article and bath. Ordinarily, a direct current system is utilized with the metal article being cleaned constituting the anode. However, under certain circumstances the polarity can be reversed. An aqueous bath is utilized in such systems and generally contains between 2 to 12 ounces of caustic per gallon of solvent, which is usually water. The cleaning is usually accomplished at temperatures in excess of about 160° F by passing electrical current through the article being cleaned for a period of time ranging from a few seconds to 5 or more minutes.

In the cleaning of conductive metallic articles, electrocleaning is principally used to remove solid soils such as carbonaceous smuts, dusts, and metal fines, although oils will also be removed in varying degrees. Generally, when heavy oil soils are present they are first removed by means of soak and spray cleaners and the article is then finally cleaned by subjecting it to an electrocleaning treatment to remove solid soils.

Conventional formulas for electrocleaners contain caustic soda to provide current carrying capacity (conductivity). They may also contain other chemicals to provide other properties. For example, sodium carbonate may be added to reduce costs and provide a freer flowing powder. Phosphate and silicates can be added, separately or together, to markedly improve cleaning power. Wetting agents also can be added to improve cleaning. Formulations may also contain defoamers and chelating agents to prevent water hardness precipitation. These compositions or formulas are added to water to produce an electrocleaning bath.

In practice, a fundamental electrocleaning formula consisting of water and caustic soda is used only when minor soils exist. In difficult cleaning jobs, such as in strip metal cleaning in steel mills or the cleaning of intricately shaped parts, caustic soda alone is not sufficient. Most always such cleaning systems also contain silicates and/or phosphates, a wetting agent and sodium carbonate as a filler. These formulas are always powders and their use presents certain inherent problems. Powders containing caustic soda must be added to hot tanks cautiously to prevent dangerous blowback due to an exothermic reaction. Original tank charges can explode if all the chemical is not dissolved and lies on the bottom of the tank. Also, powders are dusty and are difficult to feed automatically. Usually they are shoveled into a tank causing a dirty area to exist around the tank. In addition to these problems, electrocleaning compositions heretofore available to the art all exhibit limited cleaning ability.

Accordingly, it is the primary object of the invention to provide an improved method of electrocleaning metal.

Another object of the invention is to provide an additive or concentrate which may be either liquid or solid that can be used to produce an alkaline electrocleaning bath which is noted for its exceptional performance characteristics.

A further object of the invention is to provide a liquid electrocleaning bath which when used to electroclean metals significantly avoids those problems experienced when prior art electrocleaning baths or systems are utilized.

A still further object of the invention is to provide a liquid electrocleaning bath which exhibits cleaning properties that are superior or at least equal to those of a caustic bath which also contains phosphates and/or silicate without experiencing the difficulties usually attendant the use of such systems.

Other objects of the invention will become apparent to those skilled in the art from a reading of the following specification and claims.

SUMMARY OF THE INVENTION

In one aspect the present invention concerns an improved method of electrocleaning a metallic article by positioning the article in an aqueous bath and passing electrical current through the article wherein the improvement comprises, providing an aqueous bath having dissolved therein, (a) alkali metal hydroxide in an amount sufficient to impart electric conductivity to the bath and (b) an effective amount of a cleaning agent selected from the group consisting of 1-hydroxyethylidene-1,1-diphosphonic acid, an alkali metal salt of 1-hydroxyethylidene-1,1-diphosphonic acid and mixtures thereof.

In another aspect, the present invention concerns an aqueous bath for use in the electrocleaning of metals which has dissolved therein at least about 0.6 weight percent of an alkali metal hydroxide and at least about 0.005 weight percent of an alkali metal salt of 1-hydroxyethylidene-1,1-diphosphonic acid.

In still another aspect, the present invention also concerns a dry mixture of alkali metal hydroxide and 1-hydroxyethylidene-1, 1-diphosphonic acid, its alkali metal salt or a mixture thereof which can be added to a suitable solvent, such as water, to form an electrocleaning bath for use in the practice of the invention.

DESCRIPTION OF THE PREFERRED EMBODIMENTS OF THE INVENTION

In the preferred practice of the invention trace amounts, usually at least about 0.005 weight percent, of 1-hydroxyethylidene-1, 1-diphosphonic acid are added to an aqueous alkali metal containing electrocleaning bath.

This addition can be accomplished in a number of ways. For example, 1-hydroxyethylidene-1, 1-diphosphonic acid can be added to the bath as dry powder or in a liquid form. It can be added to the bath either alone or with other additives.

An aqueous bath used in the practice of the invention should contain, in weight percent, at least about 0.005 percent of the alkali metal salt of 1-hydroxyethylidene-1, 1-diphosphonic acid and at least about 0.6 percent alkali metal hydroxide.

A bath for use in the practice of the invention preferably contains, in weight percent, from about 80.0 to about 99.4 percent water, from about 0.6 to about 20 percent alkali metal hydroxide, and from about 0.001 to about 7.0 percent of the alkali metal salt of 1-hydroxyethylidene-1, 1-diphosphonic acid.

Baths used in the practice of the invention are usually produced by mixing together an electrocleaning concentrate and water.

A preferred electrocleaning concentrate used for this purpose includes, in weight percent, from about 35.0 to about 75.0 percent water, from about 25.0 to about 65.0 percent alkali metal hydroxide and from about 0.1 percent to about 7.0 percent of an alkali metal salt of 1-hydroxyethylidene-1, 1-diphosphonic acid.

The preferred alkali metal hydroxide used in the practice of the invention is selected from the group consisting of sodium hydroxide, potassium hydroxide and mixtures thereof.

The cleaning agent used in the practice of the invention is 1-hydroxyethylidene-1, 1-diphosphonic acid $[CH_3C(OH)(PO_3H_2)_2]$ which for the sake of brevity shall occasionally be referred to hereinafter as HEDP. Obviously, when HEDP is added to or mixed with an alkali metal hydroxide an alkali metal salt is formed. Accordingly, the present invention concerns the use of HEDP, its alkali metal salt or a mixture thereof.

In order to show the cleaning value of various powder and liquid formulas produced according to the teachings of this invention, use was made of the so-called Hull cell. This type of cell is well known in the electroplating art. Basically, it is a generally rectangular container made of porcelain, having one side wall at an angle of approximately 45° with respect to its opposing side wall with the other two side walls spaced apart from each other in a parallel manner. For test purposes, this cell was operated at a level of 267 ml. of electrocleaner bath so that each addition of 2 grams is equivalent to about 1 oz./gal. Normally, the 45° angle side is the anode and the 90° side is the cathode. Voltage, time and temperature are controlled and amperage is recorded. During testing, the temperature was held at 185° F for five seconds and voltage was varied as needed, usually from about 3 to 6 volts.

In using this test cell, it was found that the better the cleaner, the greater the clean area of the test panels. (As above noted, the test panel is usually anodic and at an angle of 45° with respect to the cathode). The end of the test panel closest to the cathode has the highest current density and therefore cleans easier than the opposite end. The better the cleaner the further toward the low current density end of the panel the cleaned area extends. Since the panel is 4 inches long, the maximum cleaning value can only be 4 inches.

The test panels used to evaluate the present invention were coated with a standard soil to form a standard film. The soil produced is a mixture of steel mill rolling oil, tramp mill oil, and steel fines obtained in the rolling of the steel.

In using the before described general test method, it has been discovered that even trace amounts of 1-hydroxyethylidene-1, 1-diphosphonic acid (as low as 0.001 weight percent) will improve the cleaning power of sodium or potassium hydroxide containing aqueous electrolytes or baths. The improvement in cleaning will continue to increase up to a point where 1-hydroxyethylidene-1, 1-diphosphonic acid neutralizes so much of the alkali metal hydroxide that the conductivity of the electrolyte is reduced to a point where the electrocleaning process becomes impractical. Obviously, this is true at low alkali metal hydroxide cleaner concentrations, for example at 2 to 4 ozs./gal. At higher total alkali metal hydroxide concentrations, more 1-hydroxyethylidene-1, 1-diphosphonic acid can be used, if desired. There is no fixed ratio of 1-hydroxyethylidene-1, 1-diphosphonic acid to alkali metal hydroxide that must be used. The exact formulation used is varied to suit the individual mechanical conditions and economics of the user. The only factor limiting the upper limit of alkali metal is economics. In this regard, it is to be noted that the use of even trace amounts of 1-hydroxyethylidene-1, 1-diphosphonic acid with alkali metal hydroxides improves the basic electrocleaning process. With increasing concentration of 1-hydroxyethylidene-1, 1-diphosphonic acid usually better cleaning is experienced as long as sufficient metal hydroxide is present to provide a suitable degree of conductivity. If there is sufficient hydroxide present to provide adequate conductivity an amount of 1-hydroxyethylidene-1, 1-diphosphonic sufficient to saturate the bath can be utilized.

The following tables show the benefits realized by the practice of the present invention.

Specifically, Table I shows the improvement in cleaning experience when 1-hydroxyethylidene-1, 1-diphosphonic acid is added to an alkali metal hydroxide containing electrocleaning bath. For example, in test 1(a) it is to be noted that only 0.35 inches of cleaning was experienced using a sodium hydroxide containing bath, whereas in test 1(e) 4.0 inches of cleaning was realized when 0.3 g/267 ml of 1-hydroxyethylidene-1, 1-diphosphonic acid was added to the same bath composition.

Table I

Cleaning Value of NaOH — HEDP Mixtures

| Test No. | g/267 ml NaOH | g/267 ml HEDP | Clean Area Inches | Time Sec. | Volts | Amps |
|---|---|---|---|---|---|---|
| 1a | 3.0 | 0.000 | .35 | 5.0 | 6.0 | 2.5 |
| 1b | 3.0 | 0.006 | .90 | 5.0 | 6.0 | 2.5 |
| 1c | 3.0 | 0.060 | 1.25 | 5.0 | 6.0 | 2.5 |
| 1d | 3.0 | 0.240 | 3.80 | 5.0 | 6.0 | 2.5 |
| 1e | 3.0 | 0.300 | 4.00 | 5.0 | 6.0 | 2.5 |
| 2a | 1.0 | 0.000 | 0.00 | 5.0 | 6.0 | 1.0 |
| 2b | 1.0 | 0.006 | 0.10 | 5.0 | 6.0 | 1.0 |
| 2c | 1.0 | 0.060 | 0.30 | 5.0 | 6.0 | 1.0 |
| 2d | 1.0 | 0.300 | 1.00 | 5.0 | 6.0 | 1.0 |
| 3a | 3.00 | 0.00 | 0.00 | 5.0 | 5.0 | 1.5 |
| 3b | 2.95 | 0.06 | 0.20 | 5.0 | 5.0 | 1.5 |
| 3c | 2.70 | 0.18 | 0.60 | 5.0 | 5.0 | 1.5 |
| 3d | 2.40 | 0.36 | 4.00 | 5.0 | 5.0 | 1.5 |

When potassium hydroxide was substituted for sodium hydroxide on an equimolar basis, similar results are obtained.

Table II

Sodium Hydroxide Compound to Potassium Hydroxide with HEDP

| Test No. | g/267 ml KOH | g/267 ml HEDP | Volts | Amps | Inches Cleaned |
|---|---|---|---|---|---|
| 4a | 4.11 | .06 | 4.0 | 1.25 | 0.1 |
| 4b | 3.99 | .18 | 4.0 | 1.25 | 0.2 |
| 4c | 3.78 | .36 | 4.0 | 1.00 | 4.0 |
| 4d | 3.36 | .72 | 4.0 | .75 | 4.0 light oxide |
| 4e | 2.84 | 1.08 | 4.0 | .75 | 4.0 light oxide |
| 4f | 2.52 | 1.20 | 4.0 | .50 | 4.0 oxide |
| | NaOH | | | | |
| 5a | 2.95 | .06 | 4.0 | 1.0 | 0.1 |
| 5b | 2.85 | .18 | 4.0 | 1.0 | 0.5 |

Table II-continued

| Sodium Hydroxide Compound to Potassium Hydroxide with HEDP | | | | | | |
|---|---|---|---|---|---|---|
| 5c | 2.70 | .36 | 4.0 | 1.0 | 4.0 | |
| 5d | 2.40 | .72 | 4.0 | .75 | 4.0 | light oxide |
| 5e | 2.10 | 1.08 | 4.0 | .50 | 4.0 | oxide |
| 5f | 1.80 | 1.20 | 4.0 | .50 | 4.0 | |

From the above data, it is evident that alkali metal hydroxides, other than sodium hydroxide, can be used on an equimolar basis if they have sufficient conductivity.

Various additions can be made to the alkali metal hydroxide — HEDP bath to provide improved results. Synthetic organic detergents are commonly used in alkaline cleaning baths of all types to improve oil removal. Similarly detergents can be added to alkali metal hydroxide — HEDP mixtures. It has been found that different detergents have different effects. Some detergents are better than others while some cause foam whereas others reduce foam.

It has been discovered that when detergents are added to the bath of the invention improved and often synergistic results are realized. This is particularly true when the detergent used is octylphenoxy polyethoxyethanol, preferably with approximately 10 to 13 ethoxy units per molecule. While improved results are obtained with other detergents, the above noted one produces synergistic results. (These results are set forth in Table III below).

Table III

| g/267 mls. | | Preferred | |
|---|---|---|---|
| KOH | HEDP | Detergent | Inches Cleaned |
| 3.00 | .06 | .00 | 0.2 |
| 3.00 | .00 | .033 | 0.0 |
| 3.00 | .06 | .033 | 1.0 |

Similarly, there must be sufficient HEDP in solution or the detergent at some value will have no effect. At some higher concentration of detergent its effect will return. This effect is shown in Table IV.

Table IV

| g/267 ml | | | | | |
|---|---|---|---|---|---|
| NaOH | HEDP | Detergent | Volts | Amps | Inches Cleaned |
| 2.7 | .014 | 0.0 | 6 | 2.25 | ⅜ |
| 2.7 | .014 | 0.06 | 6 | 2.25 | ⅜ |
| 2.7 | .042 | 0.0 | 6 | 2.25 | ¾ |
| 2.7 | .042 | 0.06 | 6 | 2.25 | 1½ |

Other typical detergents that have positive effects with alkali metal hydroxide — HEDP mixtures and may be used for their detergent or other effects, such as deforming, are: (a) octyl or nonyl phenoxy polyethoxy ethanols or (b) phosphate ester type detergents, (c) amine polyglycol condensates, (d) alkyl aryl polyethers, (e) modified polyethoxy adducts, (f) modified polyethoxylated alcohol, (g) ethoxylated linear alcohols, and (h) tridicyloxypolyethoxyethanol.

Iron sequestering agents, such as gluconates or glucoheptonates, can be added to the formula to assist in the tarnish removal and tarnish prevention of certain types of steel, if desired. These additional gluconates also provide some assistance in soil removal but their effect is minimal compared to HEDP. This effect increases only slowly with concentration. This is shown in Table V below.

Table V

| g/267 mg | | | | | |
|---|---|---|---|---|---|
| NaOH | HEDP | Sodium Gluconate | Volts | Amps | Inches Cleaned |
| 3.0 | 0.00 | 0.1 | 6 | 2.5 | 0.60 |
| 3.0 | 0.06 | 0.0 | 6 | 2.5 | 0.65 |
| 3.0 | 0.00 | 0.5 | 6 | 2.5 | 0.90 |
| 3.0 | 0.50 | 0.0 | 6 | 2.5 | 4.00 |
| | | Glucoheptonate | | | |
| 3.0 | 0.06 | 0.0 | 6 | 2.5 | 0.65 |
| 3.0 | 0.06 | 1.0 | 6 | 2.5 | 1.00 |
| 3.0 | 0.50 | 0.0 | 6 | 2.5 | 4.00 |

Another additive that can be used in the alkali metal hydroxide — HEDP bath is aminotri(methylphosphonic acid). This additive even in trace amounts, acts as a stabilizer for a liquid concentrate of alkali metal hydroxide and HEDP. In this case it makes the suspended solids more gelatinous which maintains the stability of the suspension.

As before noted, the benefit of the present invention can also be realized by forming a pre-mix of solid alkali metal hydroxide and dry HEDP (1-hydroxyethylidene-1, 1-diphosphonic acid), its alkali metal salt or a mixture thereof. In such a case the pre-mix composition includes from about 70 to about 99.9 weight percent alkali metal hydroxide and from about 0.1 to about 30.0 weight percent a compound selected from the group consisting of 1-hydroxyethylidene-1, 1-diphosphonic acid, an alkali metal salt of 1-hydroxyethylidene-1, 1-diphosphonic acid and mixtures thereof. Obviously, various additives, as hereinbefore described, can be added, as desired, to this basic formulation. This material can then be added to the electrocleaning bath, as desired.

While the present invention has been described with respect to the use of 1-hydroxyethylidene-1, 1-diphosphonic acid (HEDP), it is to be noted that when this acid is brought into contact with an alkali metal hydroxide it is converted to an alkali metal salt. Accordingly, the present invention concerns the use of HEDP, its alkali metal salts and a mixture of HEDP and its alkali metal salts.

While there have been described what are at present considered to be the preferred embodiments of this invention, it will be obvious to those skilled in the art that various changes and modifications may be made therein without departing from the invention, and it is, therefore, aimed in the appended claims to cover all such changes and modifications as fall within the true spirit and scope of the invention.

What is claimed is:

1. In the method of electrocleaning a metallic article by positioning said article in an aqueous bath and passing electrical current through said article, the improvement which comprises:

providing an aqueous bath having dissolved therein, (a) alkali metal hydroxide in an amount sufficient to impart electric conductivity to said bath and (b) an effective amount of a cleaning agent selected from the group consisting of 1-hydroxyethylidene-1, 1-diphosphonic acid, an alkali metal salt of 1-hydroxyethylidene-1, 1-diphosphonic acid and mixtures thereof.

2. The method of claim 1 wherein said alkali metal hydroxide is selected from the group consisting of sodium hydroxide, potassium hydroxide and mixtures thereof.

3. The method of claim 1 wherein said cleaning agent is present in said bath in an amount of at least about 0.001 weight percent.

4. The method of claim 1 wherein said alkali metal hydroxide is present in said bath in an amount of at least about 0.6 weight percent.

5. The method of claim 1 wherein said bath comprises, in weight percent, from about 80.0 to about 99.4 percent water, from about 0.6 to about 20.0 percent alkali metal hydroxide, and from about 0.001 to about 7.0 percent of an alkali metal salt of 1-hydroxyethylidene-1, 1-diphosphonic acid.

6. The method of claim 1 wherein said bath further includes a detergent.

7. The method of claim 6 wherein said detergent is octylphenoxy polyethoxyethanol.

8. The method of claim 1 wherein said bath further includes at least a trace amount of the alkali metal salt of aminotri(methyphosphonic acid).

9. The method of claim 1 wherein said bath further includes an iron sequestering agent.

10. The method of claim 1 wherein said iron sequestering agent is selected from the group consisting of gluconates, glucoheptonates and mixtures thereof.

11. A conductive aqueous bath for use in the electrocleaning of metal having dissolved therein alkali metal hydroxide and an alkali metal salt of 1-hydroxyethylidene-1, 1-diphosphonic acid.

12. The bath of claim 11 wherein said alkali metal hydroxide is selected from the group consisting of sodium hydroxide, potassium hydroxide and mixtures thereof.

13. The bath of claim 11 wherein said alkali metal salt of 1-hydroxyethylidene-1, 1-diphosphonic acid is present in an amount of at least about 0.001 weight percent.

14. The bath of claim 11 wherein said bath comprises, in weight percent, from about 80.0 to about 99.4 percent water, from about 0.6 to about 20.0 percent alkali metal hydroxide, and from about 0.001 to about 7.0 percent of an alkali metal salt of 1-hydroxyethylidene-1, 1-diphosphonic acid.

15. The bath of claim 11 wherein said bath further includes a detergent.

16. The bath of claim 15 wherein said detergent is octylphenoxy polyethoxyethanol.

17. The bath of claim 11 wherein said bath further includes at least a trace amount of an alkali metal salt of aminotri(methylphosphonic acid).

18. The bath of claim 11 wherein said bath further includes an iron sequestering agent.

19. The bath of claim 11 wherein said iron sequestering agent is selected from the group consisting of gluconates, glucoheptonates and mixtures thereof.

20. A composition adapted to be added to an aqueous solvent to form an electrocleaning bath which comprises from about 70.0 to about 99.9 weight percent of an alkali metal hydroxide and from about 0.1 to about 30.0 weight percent of a cleaning agent selected from the group consisting of 1-hydroxyethylidene-1, 1-diphosphonic acid, an alkali metal salt of 1-hydroxyethylidene-1, 1-diphosphonic acid and mixtures thereof.

21. A method of electrocleaning metallic articles which includes the steps of, providing an aqueous bath having dissolved therein (a) alkali metal hydroxide in an amount sufficient to impart electrical conductivity to said bath and (b) an effective amount of a cleaning agent selected from the group consisting of 1-hydroxyethylidene-1, 1-diphosphonic acid, an alkali metal salt of 1-hydroxyethylidene-1, 1-diphosphonic acid and mixtures thereof;

positioning said metallic article in said bath, and passing electric current through said article whereby the surface of said article is cleaned.

22. An electrocleaner concentrate adapted to be mixed with water to form a conductive bath for use in the electrocleaning of metals which comprises, in weight percent, from about 35 to about 75 percent water, from about 25 to about 65 percent alkali metal hydroxide and from about 0.1 about 7.0 percent of an alkali metal salt of 1-hydroxyethylidene-1, 1-diphosphonic acid.

* * * * *